US010603757B2

(12) United States Patent
Liu et al.

(10) Patent No.: US 10,603,757 B2
(45) Date of Patent: Mar. 31, 2020

(54) ROTARY WHEEL CLEANING DEVICE

(71) Applicant: CITIC DICASTAL CO., LTD, Qinhuangdao, Hebei (CN)

(72) Inventors: Huiying Liu, Hebei (CN); Yuexin Lu, Hebei (CN)

(73) Assignee: CITIC Dicastal CO., LTD., Qinhuangdao, Hebei (CN)

( * ) Notice: Subject to any disclaimer, the term of this patent is extended or adjusted under 35 U.S.C. 154(b) by 184 days.

(21) Appl. No.: 15/893,140

(22) Filed: Feb. 9, 2018

(65) Prior Publication Data

US 2019/0202021 A1 Jul. 4, 2019

(30) Foreign Application Priority Data

Dec. 29, 2017 (CN) ..... 2017 1 14766715

(51) Int. Cl.

| | |
|---|---|
| ***B24B 5/44*** | (2006.01) |
| ***B24B 41/06*** | (2012.01) |
| ***B24C 3/08*** | (2006.01) |
| ***B24C 3/12*** | (2006.01) |
| ***B24C 3/22*** | (2006.01) |
| ***B24B 47/10*** | (2006.01) |
| ***B24C 1/08*** | (2006.01) |

(52) U.S. Cl.

CPC ..... *B24B 5/44* (2013.01); *B24B 41/06* (2013.01); *B24B 47/10* (2013.01); *B24C 1/083* (2013.01); *B24C 3/08* (2013.01); *B24C 3/083* (2013.01); *B24C 3/085* (2013.01); *B24C 3/086* (2013.01); *B24C 3/12* (2013.01); *B24C 3/22* (2013.01)

(58) Field of Classification Search

CPC .. B24B 5/44; B24B 41/06; B24C 1/04; B24C 1/083; B24C 3/083; B24C 3/085; B24C 3/086; B24C 3/12; B24C 3/22; B24C 3/08

USPC ..... 451/38, 75, 81, 82, 102

See application file for complete search history.

(56) References Cited

U.S. PATENT DOCUMENTS

| | | | | |
|---|---|---|---|---|
| 3,362,109 A * | 1/1968 | Wallace | B05B 13/0436 | 451/38 |
| 5,512,005 A * | 4/1996 | Gulling | B24C 1/04 | 451/100 |
| 2013/0306116 A1* | 11/2013 | Imai | H01L 21/67034 | 134/95.2 |
| 2018/0282892 A1* | 10/2018 | Fujikata | C25D 17/001 | |

* cited by examiner

*Primary Examiner* — Eileen P Morgan
(74) *Attorney, Agent, or Firm* — Cooper Legal Group, LLC

(57) ABSTRACT

A rotary wheel cleaning device is composed of a feeding station, a cleaning station, a blowing station and a discharging station. The feeding station completes positioning, jacking and clamping of a wheel; the cleaning station completes cleaning of the wheel; the blowing station completes blowing of the wheel; and the discharging station transfers the cleaned wheel. The device can continuously perform the operations of feeding, cleaning, blowing and discharging of a wheel to be cleaned by rotating the wheel into different angular position on a station turntable, thereby automatic continuous production is achieved.

2 Claims, 5 Drawing Sheets

ROTARY WHEEL CLEANING DEVICE

FIELD OF THE INVENTION

The present invention relates to the technical field of cleaning, and specifically, to a device for cleaning aluminum chips and cutting fluid remaining on the surface of a wheel.

BACKGROUND ART

After a wheel is machined, a lot of chips and cutting fluid remain on the surface, and need to be cleaned first in order to facilitate subsequent automatic detection and burr removal. At present, cleaning equipment for a production line is often simple and cannot clean the wheel thoroughly in all directions, and the remaining aluminum chips may influence the subsequent automatic detection, so new automatic equipment must be developed. Based on the current situation, the present patent provides a rotary wheel cleaning device, in which a wheel can rotate in a horizontal plane and turn over during cleaning, so that the wheel is cleaned in multiple angles and multiple directions.

SUMMARY OF THE INVENTION

The aim of the present invention is to provide a rotary wheel cleaning device, which can be used for automatic continuous production, in which a wheel can rotate in a horizontal plane and turn over during cleaning, and feeding, cleaning, blowing and discharging of the wheel are orderly engaged.

In order to fulfill the above aim, the technical solution of the present invention is: a rotary wheel cleaning device is composed of a frame, a jacking cylinder, a guide post, a support plate, a guide sleeve, a lifting table, an air compressor, a central post, guide rails, a gear rack, a first sliding plate, a second sliding plate, a clamping cylinder, upright posts, positioning wheels, a support, a fifth servo motor, a bearing seat, a bearing, a shaft, a station turntable, a first servo motor, a second servo motor, a third servo motor, a fourth servo motor, a feeding station manipulator, a cleaning station manipulator, a blowing station manipulator, a discharging station manipulator, drive motors, clamping wheels, a first water tank, a first water pump, a first water spray rack, a cylinder, a waterproof cover, a second water tank, a second water pump, a water return pipeline, a second water spray rack, a first air compressor, a first blowing rack, a second air compressor, a second blowing rack and a photoelectric sensor.

The rotary wheel cleaning device is composed of a feeding station, a cleaning station, a blowing station and a discharging station. The feeding station completes positioning, jacking and clamping of a wheel; the cleaning station completes cleaning of the wheel; the blowing station completes blowing of the wheel; and the discharging station transfers the cleaned wheel.

The support plate is fixed on the frame, the guide rails are symmetrically mounted on the support plate, the first sliding plate and the second sliding plate are mounted on the guide rails and connected with each other via the gear rack, the upright posts are respectively mounted on the first sliding plate and the second sliding plate, a positioning wheel is mounted on each upright post, when the clamping cylinder drives the second sliding plate to move, the first sliding plate moves synchronously with the second sliding plate, and the positioning wheels can position the wheel. The jacking cylinder is fixed on the frame, an output end thereof is connected with the lifting table to control the lifting table under the guidance of the guide post to ascend and descend, the air compressor is mounted in the lifting table, an air outlet of the air compressor is arranged on the upper surface of the lifting table, the air compressor is used for blowing a flange face of the wheel, and the central post is mounted in the center of the upper surface of the lifting table and used for radially positioning the wheel. After the wheel is positioned on a roller bed, the positioning wheels are reset, the jacking cylinder drives the lifting table to ascend, meanwhile, the air compressor discharges compressed air to blow the flange face of the wheel, thus improving the contact precision of the upper surface of the lifting table and the flange face of the wheel, and when the upper surface of the lifting table contacts the wheel and the central post is inserted into a central hole, the wheel can be jacked to leave the roller bed, till ascending to a set height. Two arms of the feeding station manipulator at the feeding station are tightened, the wheel can be positioned and clamped, and then the lifting table descends and is reset. This is the wheel feeding station.

An output end of the fifth servo motor is connected with the station turntable, the first servo motor, the second servo motor, the third servo motor and the fourth servo motor are mounted on the station turntable at intervals of 90 degrees in the circumferential direction, an output end of the first servo motor is connected with the feeding station manipulator, an output end of the second servo motor is connected with the cleaning station manipulator, an output end of the third servo motor is connected with the blowing station manipulator, an output end of the fourth servo motor is connected with the discharging station manipulator, the drive motors are mounted on two arms of the manipulators, and a clamping wheel is mounted at the output end of each drive motor; and after the wheel is clamped, the drive motors can drive the wheel to rotate in a horizontal plane, and the first servo motor, the second servo motor, the third servo motor and the fourth servo motor can drive the wheel to turn over up and down. When the fifth servo motor drives the station turntable to rotate 90 degrees every time, cyclic switching of the four manipulators can be realized.

The first water tank and the first water spray rack are mounted on the frame above the cleaning station manipulator, and the first water pump is arranged in the first water tank to supply water to the first water tank. Four nozzles are uniformly distributed on the first water tank in the circumferential direction, and the remaining nozzles are arranged in a transverse—shape. The cylinder is fixed at the top of the frame, the waterproof cover is mounted at an output end of the cylinder, the waterproof cover is controlled under the guidance of the guide post to ascend and descend, and the waterproof cover can prevent water from splashing when the wheel is cleaned. The second water tank and the second water spray rack are mounted on the frame below the cleaning station manipulator, and the second water pump is arranged in the second water tank to supply water to the second water spray rack. Four nozzles are uniformly distributed on the second water spray rack in the circumferential direction. The nozzles arranged on the first water spray rack and the second water spray rack are crossed vertically, and the wheel is in a rotating state during cleaning, so the wheel can be cleaned thoroughly, and the purpose of saving water can be fulfilled. This is the wheel cleaning station.

The first air compressor and the first blowing rack are mounted on the frame above the blowing station manipulator, the air outlet layout of the first blowing rack is consistent with the nozzle layout of the first water spray rack, and four air outlets are uniformly distributed in the circumferential direction. The second air compressor and the second blowing rack are mounted on the frame below the blowing station manipulator, the air outlet layout of the second blowing rack is consistent with the nozzle layout of the second water spray rack, and four air outlets are uniformly distributed in the circumferential direction. This is the wheel blowing station.

The photoelectric sensor is mounted on the roller bed below the discharging station manipulator; when the wheel is transferred to the discharging station, the manipulator releases the wheel to the roller bed; and when the photoelectric sensor detects the wheel, the roller bed rotates to transfer the wheel. This is the wheel discharging station.

The working process of the rotary wheel cleaning device is: firstly, after the wheel is positioned on the roller bed, the positioning wheels are reset, the jacking cylinder drives the lifting table to ascend, meanwhile, the air compressor discharges compressed air to blow the flange face of the wheel, when the upper surface of the lifting table contacts the wheel and the central post is inserted into the central hole, the wheel can be jacked to leave the roller bed and ascend to a set height, two arms of the feeding station manipulator are tightened, the wheel is positioned and clamped, and then the lifting table descends and is reset. Then, the fifth servo motor drives the station turntable to rotate 90 degrees anticlockwise, the discharging station manipulator rotates to the feeding station, and next wheel is positioned, jacked and clamped; the wheel clamped by the feeding station manipulator rotates to the cleaning station, the cylinder is started to drive the waterproof cover to descend, the first water pump and the second water pump are simultaneously started to clean the wheel, the drive motors drive the clamping wheels to rotate in the wheel cleaning process, the wheel rotates in a horizontal plane, the first servo motor is started to drive the wheel to turn over up and down, and the wheel is cleaned in multiple angles and multiple directions. After the wheel is cleaned, the waterproof cover ascends and is reset, the discharging station manipulator has clamped next wheel to be cleaned, then the fifth servo motor drives the station turntable again to rotate 90 degrees anticlockwise, the blowing station manipulator rotates to the feeding station via two times of rotation, and next wheel is positioned, jacked and clamped; the wheel clamped by the discharging station manipulator rotates to the cleaning station and is cleaned, the wheel clamped by the feeding station manipulator rotates to the blowing station, the first air compressor and the second air compressor are simultaneously started to blow the wheel, the drive motors drive the clamping wheels to rotate in the wheel blowing process, the wheel rotates in the horizontal plane, the first servo motor is started to drive the wheel to turn over up and down, and the wheel is blown in multiple angles and multiple directions. After the wheel is blown, the blowing station manipulator has clamped next wheel to be cleaned, the wheel clamped by the discharging station manipulator has been cleaned, then the fifth servo motor drives the station turntable again to rotate 90 degrees anticlockwise, the cleaning station manipulator rotates to the feeding station via three times of rotation, and next wheel is positioned, jacked and clamped; the wheel clamped by the blowing station manipulator rotates to the cleaning station and is cleaned, the wheel clamped by the discharging station manipulator rotates to the blowing station and is blown, and the wheel clamped by the feeding station manipulator rotates to the discharging station and is released and transferred. After the wheel is transferred, the cleaning station manipulator has clamped next wheel to be cleaned, the wheel clamped by the blowing station manipulator has been cleaned, the wheel clamped by the discharging station manipulator has been blown, then the fifth servo motor drives the station turntable again to rotate 90 degrees anticlockwise, the feeding station manipulator returns to the feeding station via four times of rotation, so far, a single cycle of feeding, cleaning, blowing and discharging of a wheel is completed. At the moment, the device enters a stable full-load running state; when a wheel is fed at the feeding station, a wheel is cleaned at the cleaning station, a wheel is blown at the blowing station, and a wheel is transferred at the discharging station; and the four stations are closely connected with each other and independent from each other, so the period is short and the efficiency is high.

The device can be used for automatic continuous production, in which the wheel can rotate in a horizontal plane and turn over during cleaning, so that the wheel is cleaned in multiple angles and multiple directions; and by skillful layout, feeding, cleaning, blowing and discharging of the wheel are orderly engaged, so that the cleaning process is coherent and cyclic, the period is short and the efficiency is high.

Figure 1:
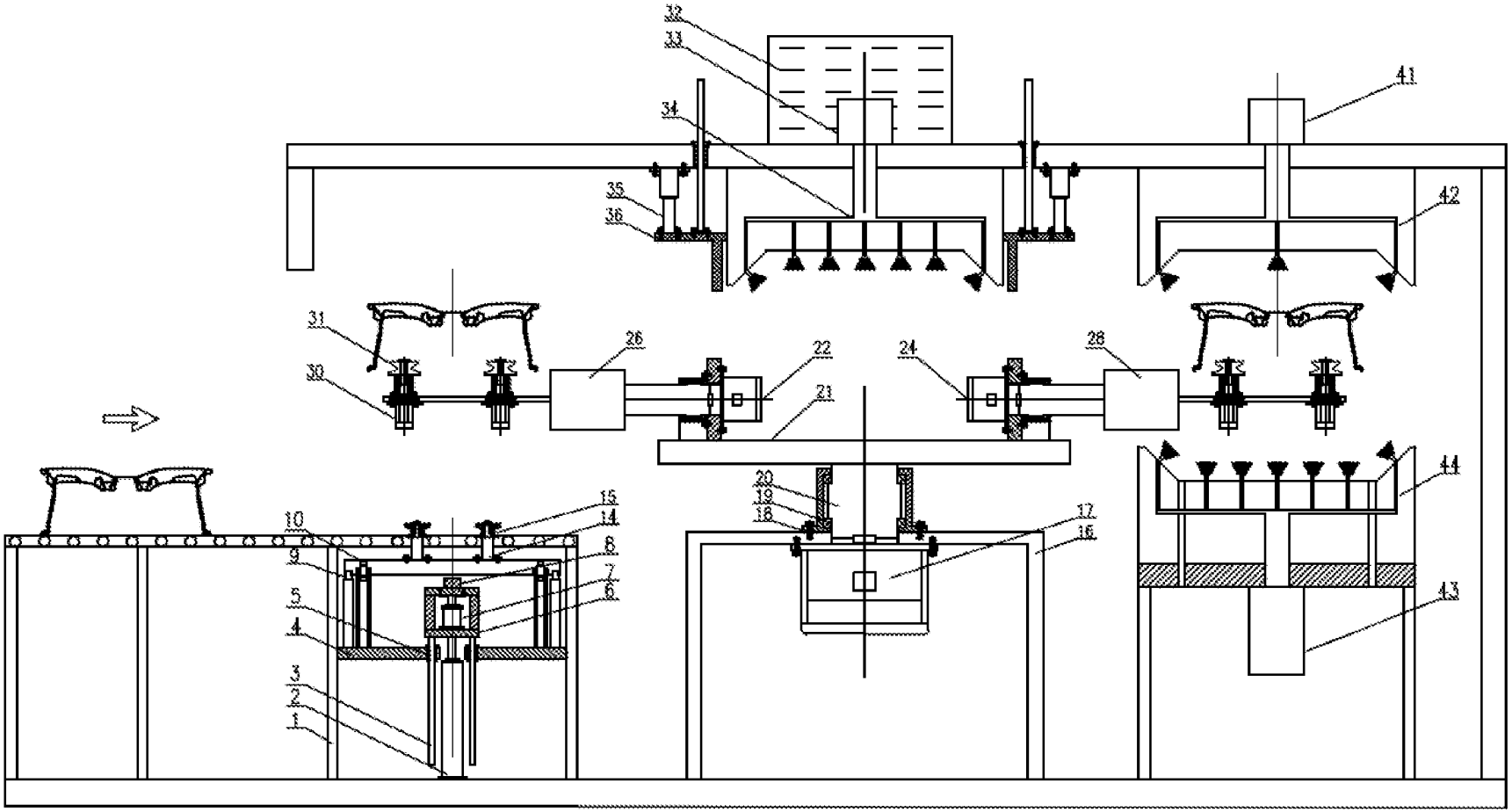
FIG. 1 is a front view of a rotary wheel cleaning device of the present invention.
Figure 2:
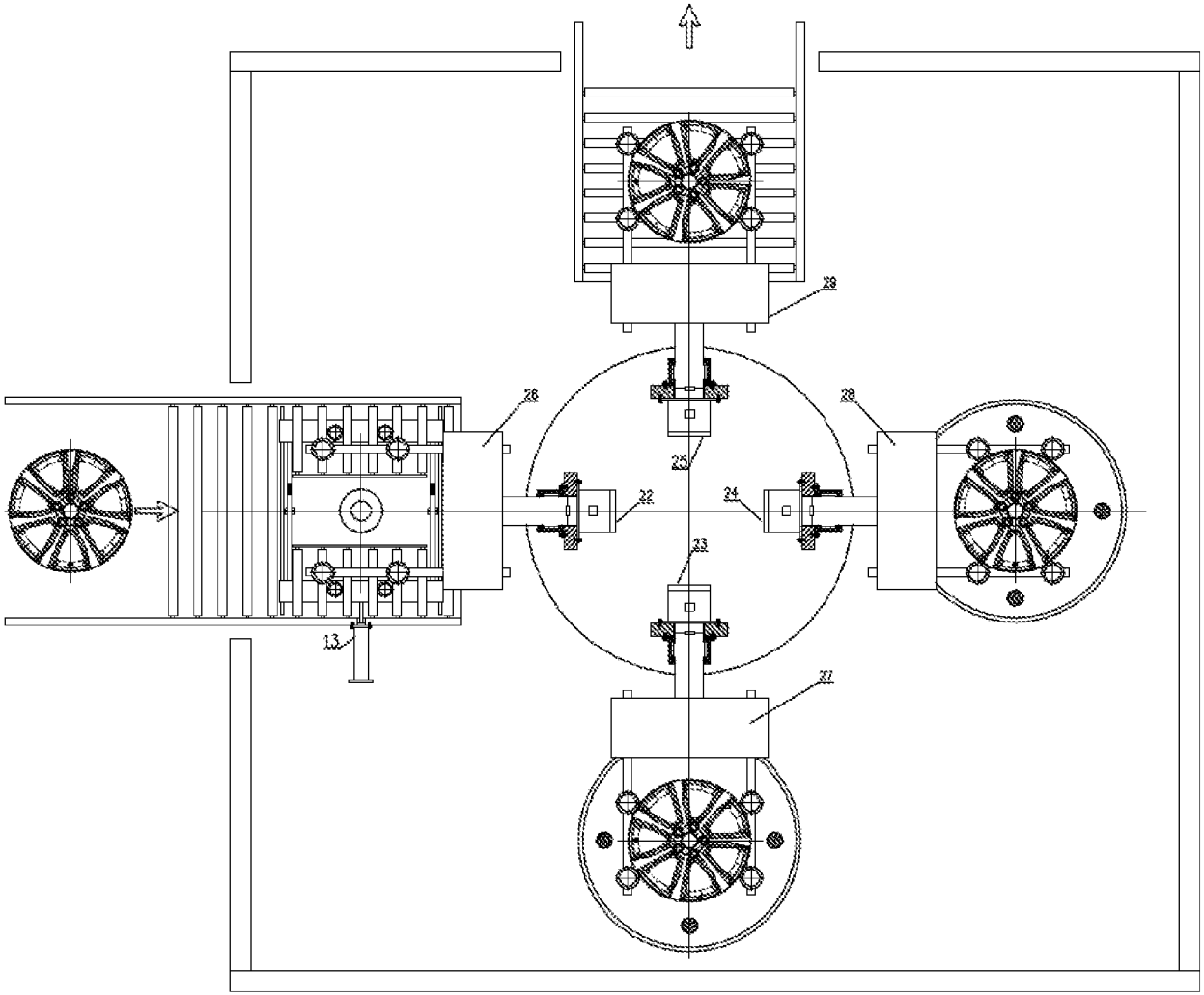
FIG. 2 is a top view of the rotary wheel cleaning device of the present invention.
Figure 3:
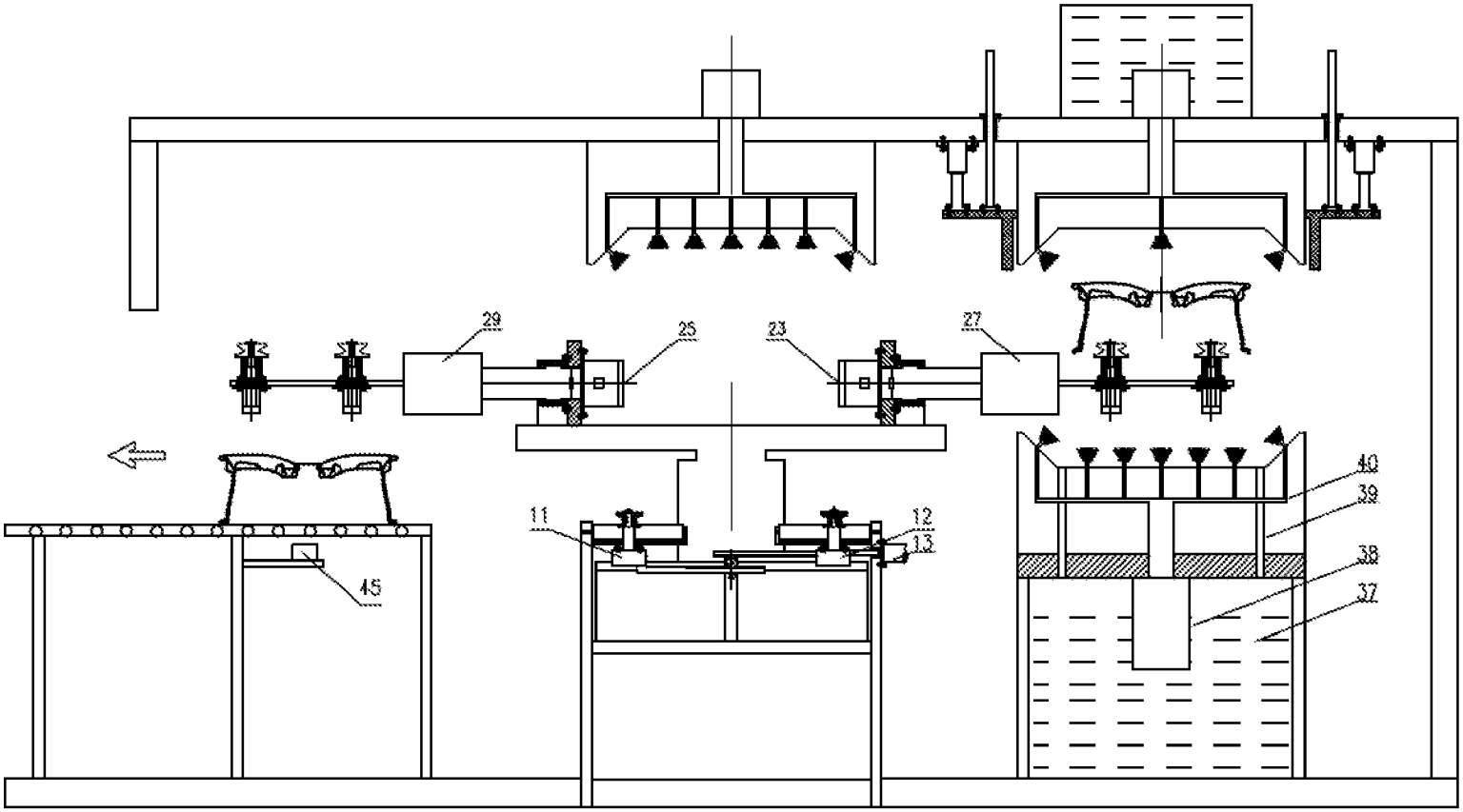
FIG. 3 is a left view of the rotary wheel cleaning device of the present invention.
Figure 4:
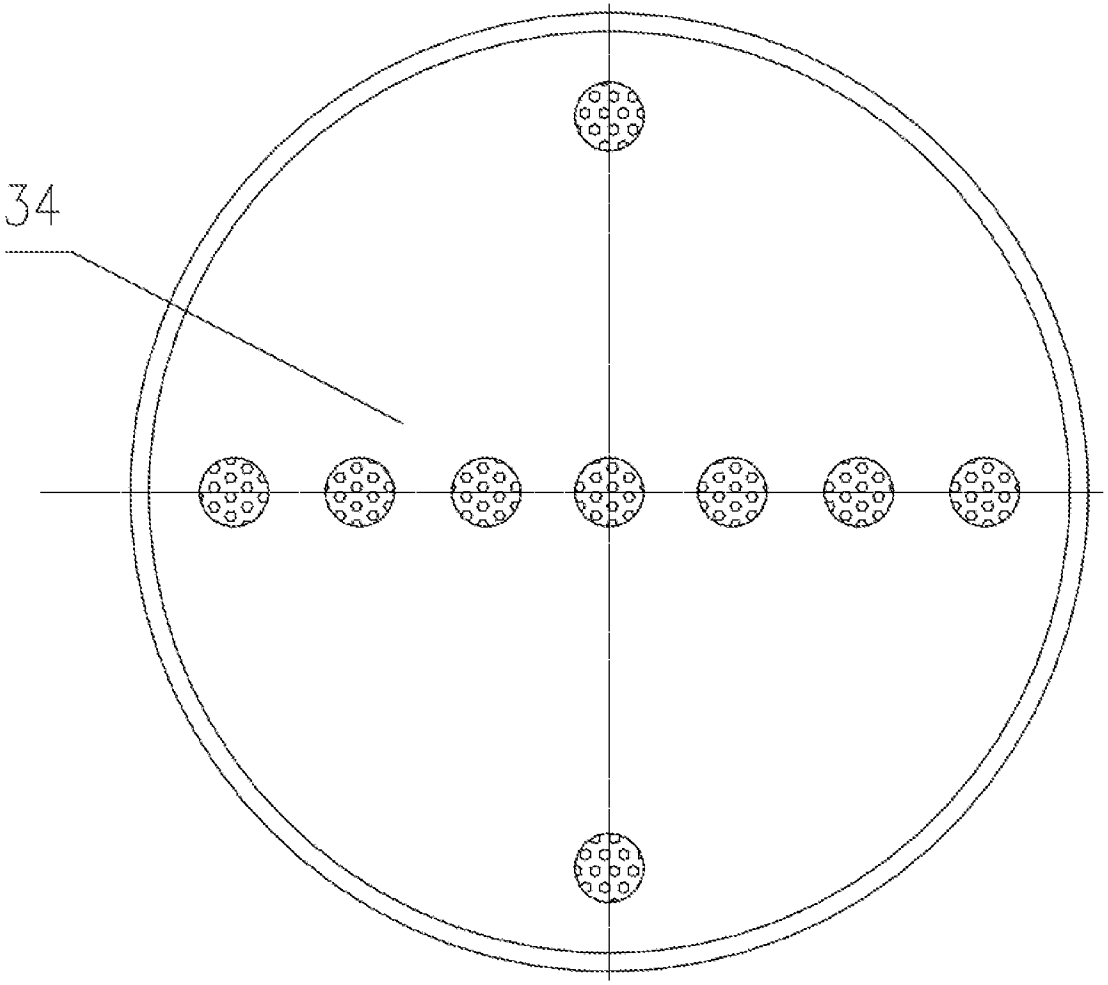
FIG. 4 is an enlarged bottom view of a first water spray rack of the rotary wheel cleaning device of the present invention.
Figure 5:
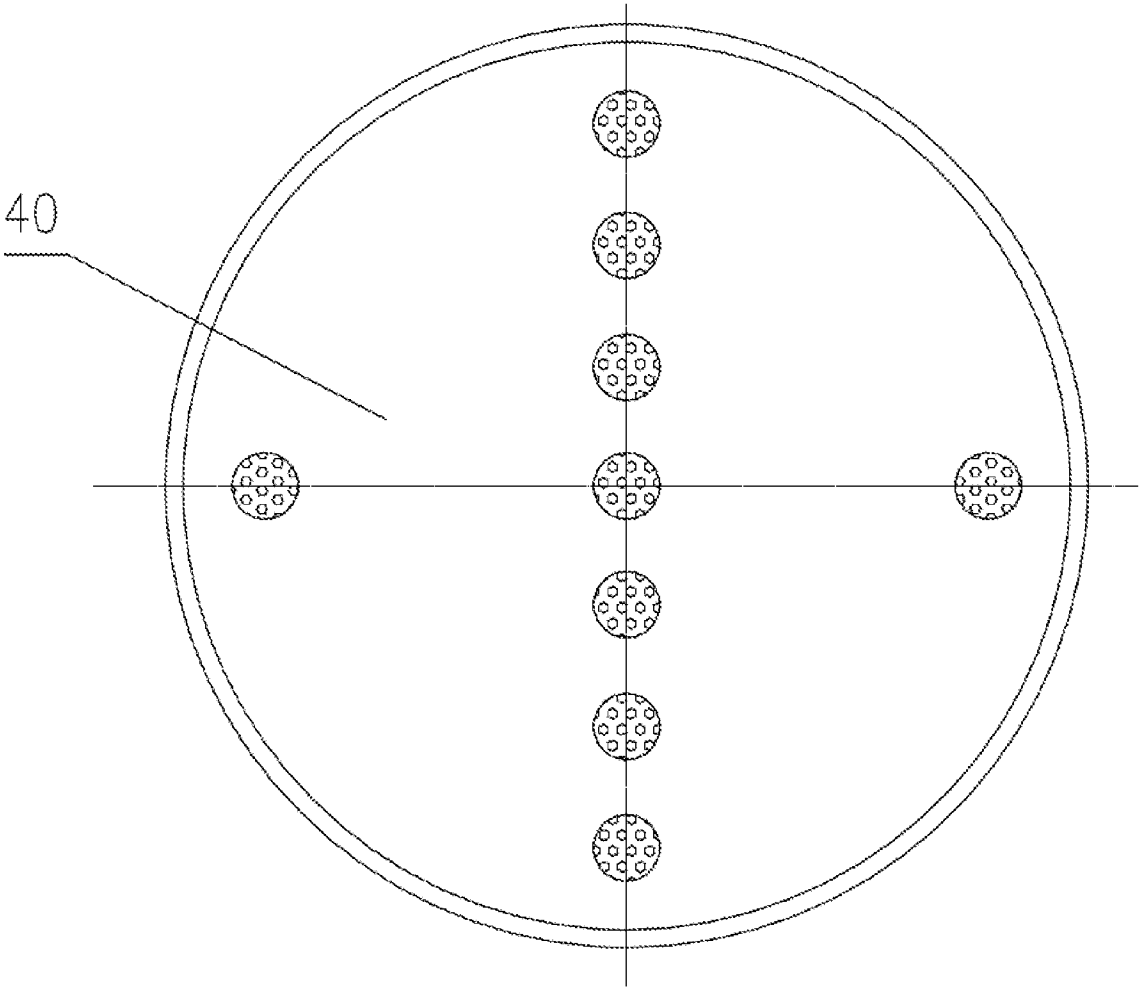
FIG. 5 is an enlarged top view of a second water spray rack of the rotary wheel cleaning device of the present invention.

In which, 1-frame, 2-jacking cylinder, 3-guide post, 4-support plate, 5-guide sleeve, 6-lifting table, 7-air compressor, 8-central post, 9-guide rail, 10-gear rack, 11-first sliding plate, 12-second sliding plate, 13-clamping cylinder, 14-upright post, 15-positioning wheel, 16-support, 17-fifth servo motor, 18-bearing seat, 19-bearing, 20-shaft, 21-station turntable, 22-first servo motor, 23-second servo motor, 24-third servo motor, 25-fourth servo motor, 26-feeding station manipulator, 27-cleaning station manipulator, 28-blowing station manipulator, 29-discharging station manipulator, 30-drive motor, 31-clamping wheel, 32-first water tank, 33-first water pump, 34-first water spray rack, 35-cylinder, 36-waterproof cover, 37-second water tank, 38-second water pump, 39-water return pipeline, 40-second water spray rack, 41-first air compressor, 42-first blowing rack, 43-second air compressor, 44-second blowing rack, 45-photoelectric sensor.

DETAILED DESCRIPTION OF THE EMBODIMENTS

Specific details and working conditions of a device provided by the present invention will be described below in combination with the accompanying drawings.

A rotary wheel cleaning device is composed of a frame 1, a jacking cylinder 2, a guide post 3, a support plate 4, a guide sleeve 5, a lifting table 6, an air compressor 7, a central post 8, guide rails 9, a gear rack 10, a first sliding plate 11, a second sliding plate 12, a clamping cylinder 13, upright posts 14, positioning wheels 15, a support 16, a fifth servo motor 17, a bearing seat 18, a bearing 19, a shaft 20, a station turntable 21, a first servo motor 22, a second servo motor 23, a third servo motor 24, a fourth servo motor 25, a feeding station manipulator 26, a cleaning station manipulator 27, a blowing station manipulator 28, a discharging station manipulator 29, drive motors 30, clamping wheels 31, a first water tank 32, a first water pump 33, a first water spray rack 34, a cylinder 35, a waterproof cover 36, a second water tank 37, a second water pump 38, a water return pipeline 39, a second water spray rack 40, a first air compressor 41, a first blowing rack 42, a second air compressor 43, a second blowing rack 44 and a photoelectric sensor 45.

The rotary wheel cleaning device is composed of a feeding station, a cleaning station, a blowing station and a discharging station. The feeding station completes positioning, jacking and clamping of a wheel; the cleaning station completes cleaning of the wheel; the blowing station completes blowing of the wheel; and the discharging station transfers the cleaned wheel.

The support plate 4 is fixed on the frame 1, the guide rails 9 are symmetrically mounted on the support plate 4, the first sliding plate 11 and the second sliding plate 12 are mounted on the guide rails 9 and connected with each other via the gear rack 10, the upright posts 14 are respectively mounted on the first sliding plate 11 and the second sliding plate 12, a positioning wheel 15 is mounted on each upright post 14, when the clamping cylinder 13 drives the second sliding plate 12 to move, the first sliding plate 11 moves synchronously with the second sliding plate 12, and the positioning wheels 15 can position the wheel. The jacking cylinder 2 is fixed on the frame 1, an output end thereof is connected with the lifting table 6 to control the lifting table 6 under the guidance of the guide post 3 to ascend and descend, the air compressor 7 is mounted in the lifting table 6, an air outlet of the air compressor 7 is arranged on the upper surface of the lifting table 6, the air compressor 7 is used for blowing a flange face of the wheel, and the central post 8 is mounted in the center of the upper surface of the lifting table 6 and used for radially positioning the wheel. After the wheel is positioned on a roller bed, the positioning wheels 15 are reset, the jacking cylinder 2 drives the lifting table 6 to ascend, meanwhile, the air compressor 7 discharges compressed air to blow the flange face of the wheel, thus improving the contact precision of the upper surface of the lifting table 6 and the flange face of the wheel, and when the upper surface of the lifting table 6 contacts the wheel and the central post 8 is inserted into a central hole, the wheel can be jacked to leave the roller bed, till ascending to a set height. Two arms of the feeding station manipulator 26 at the feeding station are tightened, the wheel can be positioned and clamped, and then the lifting table 6 descends and is reset. This is the wheel feeding station.

An output end of the fifth servo motor 17 is connected with the station turntable 21, the first servo motor 22, the second servo motor 23, the third servo motor 24 and the fourth servo motor 25 are mounted on the station turntable 21 at intervals of 90 degrees in the circumferential direction, an output end of the first servo motor 22 is connected with the feeding station manipulator 26, an output end of the second servo motor 23 is connected with the cleaning station manipulator 27, an output end of the third servo motor 24 is connected with the blowing station manipulator 28, an output end of the fourth servo motor 25 is connected with the discharging station manipulator 29, the drive motors 30 are mounted on two arms of the manipulators, and a clamping wheel 31 is mounted at the output end of each drive motor 30; and after the wheel is clamped, the drive motors 30 can drive the wheel to rotate in a horizontal plane, and the first servo motor 22, the second servo motor 23, the third servo motor 24 and the fourth servo motor 25 can drive the wheel to turn over up and down. When the fifth servo motor 17 drives the station turntable 21 to rotate 90 degrees every time, cyclic switching of the four manipulators can be realized.

The first water tank 32 and the first water spray rack 34 are mounted on the frame above the cleaning station manipulator 27, and the first water pump 33 is arranged in the first water tank 32 to supply water to the first water tank 32. Four nozzles are uniformly distributed on the first water tank 32 in the circumferential direction, and the remaining nozzles are arranged in a transverse—shape. The cylinder 35 is fixed at the top of the frame, the waterproof cover 36 is mounted at the output end of the cylinder 35, the waterproof cover 36 is controlled under the guidance of the guide post to ascend and descend, and the waterproof cover 36 can prevent water from splashing when the wheel is cleaned. The second water tank 37 and the second water spray rack 40 are mounted on the frame below the cleaning station manipulator 27, and the second water pump 38 is arranged in the second water tank 37 to supply water to the second water spray rack 40. Four nozzles are uniformly distributed on the second water spray rack 40 in the circumferential direction. The nozzles arranged on the first water spray rack 34 and the second water spray rack 40 are crossed vertically, and the wheel is in a rotating state during cleaning, so the wheel can be cleaned thoroughly, and the purpose of saving water can be fulfilled. This is the wheel cleaning station.

The first air compressor 41 and the first blowing rack 42 are mounted on the frame above the blowing station manipulator 28, the air outlet layout of the first blowing rack 42 is consistent with the nozzle layout of the first water spray rack 34, and four air outlets are uniformly distributed in the circumferential direction. The second air compressor 43 and the second blowing rack 44 are mounted on the frame below the blowing station manipulator 28, the air outlet layout of the second blowing rack 44 is consistent with the nozzle layout of the second water spray rack 40, and four air outlets are uniformly distributed in the circumferential direction. This is the wheel blowing station.

The photoelectric sensor 45 is mounted on the roller bed below the discharging station manipulator 29; when the wheel is transferred to the discharging station, the manipulator releases the wheel to the roller bed; and when the photoelectric sensor 45 detects the wheel, the roller bed rotates to transfer the wheel. This is the wheel discharging station.

The working process of the rotary wheel cleaning device is: firstly, after the wheel is positioned on the roller bed, the positioning wheels 15 are reset, the jacking cylinder 2 drives the lifting table 6 to ascend, meanwhile, the air compressor 7 discharges compressed air to blow the flange face of the wheel, when the upper surface of the lifting table 6 contacts the wheel and the central post 8 is inserted into the central hole, the wheel can be jacked to leave the roller bed and ascend to a set height, two arms of the feeding station manipulator 26 are tightened, the wheel is positioned and clamped, and then the lifting table 6 descends and is reset. Then, the fifth servo motor 17 drives the station turntable 21 to rotate 90 degrees anticlockwise, the discharging station manipulator 29 rotates to the feeding station, and next wheel is positioned, jacked and clamped; the wheel clamped by the feeding station manipulator 26 rotates to the cleaning station, the cylinder 35 is started to drive the waterproof cover 36 to descend, the first water pump 33 and the second water pump 38 are simultaneously started to clean the wheel, the drive motors 30 drive the clamping wheels 31 to rotate in the wheel cleaning process, the wheel rotates in a horizontal plane, the first servo motor 22 is started to drive the wheel to turn over up and down, and the wheel is cleaned in multiple angles and multiple directions. After the wheel is cleaned, the waterproof cover 36 ascends and is reset, the discharging station manipulator 29 has clamped next wheel to be cleaned, then the fifth servo motor 17 drives the station turntable 21 again to rotate 90 degrees anticlockwise, the blowing station manipulator 28 rotates to the feeding station via two times of rotation, and next wheel is positioned, jacked and clamped; the wheel clamped by the discharging station manipulator 29 rotates to the cleaning station and is cleaned, the wheel clamped by the feeding station manipulator 26 rotates to the blowing station, the first air compressor 41 and the second air compressor 43 are simultaneously started to blow the wheel, the drive motors 30 drive the clamping wheels 31 to rotate in the wheel blowing process, the wheel rotates in the horizontal plane, the first servo motor 22 is started to drive the wheel to turn over up and down, and the wheel is blown in multiple angles and multiple directions. After the wheel is blown, the blowing station manipulator 28 has clamped next wheel to be cleaned, the wheel clamped by the discharging station manipulator 29 has been cleaned, then the fifth servo motor 17 drives the station turntable 21 again to rotate 90 degrees anticlockwise, the cleaning station manipulator 27 rotates to the feeding station via three times of rotation, and next wheel is positioned, jacked and clamped; the wheel clamped by the blowing station manipulator 28 rotates to the cleaning station and is cleaned, the wheel clamped by the discharging station manipulator 29 rotates to the blowing station and is blown, and the wheel clamped by the feeding station manipulator 26 rotates to the discharging station and is released and transferred. After the wheel is transferred, the cleaning station manipulator 27 has clamped next wheel to be cleaned, the wheel clamped by the blowing station manipulator 28 has been cleaned, the wheel clamped by the discharging station manipulator 29 has been blown, then the fifth servo motor 17 drives the station turntable 21 again to rotate 90 degrees anticlockwise, the feeding station manipulator 26 returns to the feeding station via four times of rotation, so far, a single cycle of feeding, cleaning, blowing and discharging of a wheel is completed. At the moment, the device enters a stable full-load running state; when a wheel is fed at the feeding station, a wheel is cleaned at the cleaning station, a wheel is blown at the blowing station, and a wheel is transferred at the discharging station; and the four stations are closely connected with each other and independent from each other, so the period is short and the efficiency is high.

The device can be used for automatic continuous production, in which the wheel can rotate in a horizontal plane and turn over during cleaning, so that the wheel is cleaned in multiple angles and multiple directions; and by skillful layout, feeding, cleaning, blowing and discharging of the wheel are orderly engaged, so that the cleaning process is coherent and cyclic, the period is short and the efficiency is high.

The invention claimed is:

1. A rotary vehicle wheel cleaning device, comprising a frame, a jacking cylinder, a guide post, a support plate, a guide sleeve, a lifting table, an air compressor, a central post, two guide rails, a gear rack, a first sliding plate, a second sliding plate, a clamping cylinder, two upright posts, two positioning wheels, a support, a servo motor, a bearing seat, a bearing, a shaft, a station turntable, a first servo motor, a second servo motor, a third servo motor, a fourth servo motor, a feeding station manipulator, a cleaning station manipulator, a blowing station manipulator, a discharging station manipulator, sixteen drive motors, sixteen clamping wheels for clamping a vehicle wheel, a first water tank, a first water pump, a first water spray rack, a cylinder, a waterproof cover, a second water tank, a second water pump, a water return pipeline, a second water spray rack, a first air compressor, a first blowing rack, a second air compressor, a second blowing rack and a photoelectric sensor;

wherein each of the first servo motor, the second servo motor, the third servo motor and the fourth servo motor is mounted on the station turntable at intervals of 90 degrees in a circumferential direction of the station turntable from the adjacent ones, an output end of the first servo motor is connected with the feeding station manipulator, an output end of the second servo motor is connected with the cleaning station manipulator, an output end of the third servo motor is connected with the blowing station manipulator, an output end of the fourth servo motor is connected with the discharging station manipulator, each of the feeding station manipulator, the cleaning station manipulator, the blowing station manipulator and the discharging station manipulator has two arms, two drive motors of the sixteen drive motors are mounted on each arm of the two arms of each of the feeding station manipulator, the cleaning station manipulator, the blowing station manipulator and the discharging station manipulator, and a clamping wheel of the sixteen clamping wheels is mounted at an output end of each drive motor of the sixteen drive motors;

wherein after the vehicle wheel is clamped, the sixteen drive motors are configured to drive the vehicle wheel to rotate in a horizontal plane, and the first servo motor, the second servo motor, the third servo motor and the fourth servo motor are configured to drive the vehicle wheel to turn over;

wherein the first water tank and the first water spray rack are mounted on the frame above the cleaning station manipulator, and the first water pump is arranged in the first water tank to supply water to the first water spray rack;

wherein the rotary vehicle wheel cleaning device further comprises:

four first nozzles that are uniformly distributed on the first water spray rack in a circumferential direction of the first water spray rack and five first nozzles that are arranged in a row on the first water spray rack in a first direction;

wherein the second water tank and the second water spray rack are mounted on the frame below the cleaning station manipulator, and the second water pump is arranged in the second water tank to supply water to the second water spray rack;

wherein the rotary vehicle wheel cleaning device further comprises:

four second nozzles that are uniformly distributed on the second water spray rack in a circumferential direction of the second water spray rack and five second nozzles that are arranged in a column on the second water spray rack in a second direction;

wherein the first direction is perpendicular to the second direction;

wherein the first water pump and the second water pump are started to clean the vehicle wheel; and wherein the station turntable is configured to continuously rotate the vehicle wheel to one of a feeding station, a cleaning station, a blowing station or a discharging station, and a corresponding cleaning operation for the vehicle wheel is carried out at each of the feeding station, the cleaning station, the blowing station, and the discharging station.

2. The rotary vehicle wheel cleaning device according to claim 1, wherein the first blowing rack is mounted on the frame above the blowing station manipulator and the second blowing rack is mounted on the frame below the blowing station manipulator, nine first air outlets are arranged on the first blowing rack and nine second air outlets are arranged on the second blowing rack, four first air outlets of the nine first air outlets are uniformly distributed on the first blowing rack in a circumferential direction of the first blowing rack and a remaining five first air outlets of the nine first air outlets are arranged in a row on the first blowing rack in the first direction, and four second air outlets of the nine second air outlets are uniformly distributed on the second blowing rack in a circumferential direction of the second blowing rack and a remaining five second air outlets of the nine second air outlets are arranged in a column on the second blowing rack in the second direction.

* * * * *